United States Patent [19]

Staley

[11] Patent Number: 5,040,245

[45] Date of Patent: Aug. 20, 1991

[54] UNDERGARMENT HAVING STRETCH PANELS

[76] Inventor: William L. Staley, 10265 Gandy Blvd., #1214, St. Petersburg, Fla. 33702

[21] Appl. No.: 506,668

[22] Filed: Apr. 9, 1990

Related U.S. Application Data

[63] Continuation-in-part of Ser. No. 475,340, Feb. 5, 1990.

[51] Int. Cl.[5] ..... A41B 11/00

[52] U.S. Cl. ..... 2/409; 2/61; 2/239; 66/178 R

[58] Field of Search ..... 2/61, 239, 409; 66/178 R, 196

[56] References Cited

U.S. PATENT DOCUMENTS

| | | |
|---|---|---|
| 256,532 | 4/1882 | Appleton . |
| 319,131 | 6/1885 | Ryer . |
| 2,239,593 | 4/1941 | Crawford . |
| 2,664,570 | 1/1954 | Artzt . |
| 2,826,760 | 3/1958 | Rice . |
| 3,020,556 | 2/1962 | Isley . |
| 3,566,624 | 3/1971 | Burleson . |
| 3,595,034 | 7/1971 | Safrit . |
| 3,808,842 | 5/1974 | Fisher et al. . |
| 3,933,013 | 1/1976 | Cassidy, Sr. . |
| 3,956,906 | 5/1976 | Cassidy, Sr. . |
| 4,091,466 | 5/1978 | Kearn . |
| 4,126,903 | 11/1978 | Horton . |
| 4,133,054 | 6/1979 | Harper . |
| 4,150,554 | 4/1979 | Cassidy, Sr. . |
| 4,213,312 | 7/1980 | Safrit et al. . |
| 4,267,607 | 5/1981 | Tino . |
| 4,368,546 | 1/1983 | White . |
| 4,445,345 | 5/1984 | Bedier . |
| 4,506,392 | 3/1985 | White . |
| 4,625,336 | 12/1986 | Derderian . |
| 4,870,708 | 10/1989 | Staley . |

FOREIGN PATENT DOCUMENTS

| | | | |
|---|---|---|---|
| 2909613 | 9/1980 | Fed. Rep. of Germany | 2/409 |
| 1266927 | 3/1972 | United Kingdom . | |

*Primary Examiner*—Werner H. Schroeder
*Assistant Examiner*—Jeanette E. Chapman
*Attorney, Agent, or Firm*—Foley & Lardner

[57] ABSTRACT

An undergarment according to the invention which covers the body from the waist down has stretch panels in the thigh area which permit the undergarment to fit over the thigh, while permitting the rest of the leg covering portion to be made form heavier material than conventional panty hose. The sock portions of the garment can be knitted continuously with the leg portions. Such an undergarment provides a better fit together with advantages such as light weight, warmth, and comfort.

18 Claims, 3 Drawing Sheets

UNDERGARMENT HAVING STRETCH PANELS

This application is a continuation-in-part of Ser. No. 07/475,340, filed Feb. 5, 1990, pending.

TECHNICAL FIELD

This invention relates to hosiery, particularly to knitted one-piece undergarments which cover the wearer from the waist down. More particularly, this invention relates to a one-piece, light weight undergarment especially suited for men.

BACKGROUND OF THE INVENTION

Knitted hosiery such as women's panty hose has long been known, and a wide variety of designs for such hosiery have been proposed. Such undergarments generally cover the waist, legs, and optionally the feet of the wearer. See, for example, Harper U.S. Pat. No. 4,133,054, issued June 9, 1979, Appleton U.S. Pat. No. 256,532, issued Apr. 18, 1882, Artzt U.S. Pat. No. 2,664,570, issued Jan. 5, 1954, Bedier U.S. Pat. No. 4,445,345, issued May 1, 1984, Fisher et al. U.S. Pat. No. 3,808,842, issued May 7, 1974, and Baynes British Patent No. 1,210,544, published Oct. 28, 1970. Such hosiery is often knitted on a circular knitting machine and then assembled from a pair of tubular knitted blanks.

Some such garments provide separate stocking and panty portions which are sewn together at a seam (e.g., Rice U.S. Pat. No. 2,826,760, issued Mar. 18, 1958) or knitted together continuously (e.g., Safrit et al., U.S. Pat. No. 4,213,312, issued July 22, 1980). Elastic fabrics such as spandex have been incorporated into the panty portion of such garments to provide a "control top" at the waist or belly, and to impart a decorative pattern to the garment. See, in particular, Cassidy, Sr. U.S. Pat. Nos. 3,933,013, issued Jan. 20, 1976, and 3,956,906, issued May 18, 1976 and Safrit U.S. Pat. No. 3,595,034, issued July 27, 1971. Reinforced waistbands for panty hose are also well known, as exemiplified by Cassidy, Sr. U.S. Pat. No. 4,150,554, issued Apr. 24, 1979 as are reinforced bands located so as to facilitate the wearer in fitting the leg portion of the panty hose over the leg, as exemplified by Tino U.S. Pat. No. 4,267,607, issued May 19, 1981.

Women's nylons have been provided with reinforced heel and toe portions. See the Harper patent cited above, and Taylor U.S. Pat. No. 1,227,217, issued May 22, 1917. Women's combination garments having a plurality of different portions of varying design including a body portion, an upper leg portion and a lower leg portion are also known. See, e.g., Germany Patent No. 29 09 613, dated Sept. 18, 1980, and Charnos Limited British Patent No. 1,266,927, published Mar. 15, 1972.

Long underwear and athletic undergarments which cover the lower half of the body, sometimes excluding the feet, are also well known. Note, for example, Kearn U.S. Pat. No. 4,091,466, issued May 30, 1978 and Derderian U.S. Pat. No. 4,625,336, issued Dec. 2, 1986. In an early design, a sock is releasably secured to a stocking so that it could be removed and replaced when soiled or worn beyond use (Ryan U.S. Pat. No. 319,131, issued June 2, 1885). Another known garment provides a pair of athletic socks which are sewn to the bottom ends of the stocking portions of a support hose undergarment. See White U.S. Pat. Nos. 4,368,546, issued Jan. 18, 1983, and 4,506,392, issued Mar. 26, 1985.

With the exception of long underwear and certain athletic undergarments, modern panty hose has been designed exclusively for women. Women's panty hose offer a number of advantages over long underwear currently sold to men. Panty hose is relatively light weight as compared to long underwear, and is made with sufficent elasticity to resiliently support the legs. Such support can improve blood circulation in the legs, especially in older persons. Long underwear is also bulky and difficult to wear under other clothing as compared to panty hose.

Use by men of women's panty hose has proven unsatisfactory in practice. The panty hose fits poorly because it is configured to the shape of a woman's body, not a man's. High top socks (knee socks) tend to sag when worn over panty hose made of a synthetic fabric such as nylon unless the socks have a tight, relatively thin top elastic band. Such a tight, thin band is uncomfortable and can defeat the circulation-improving effects of the support hose. Men who wear ordinary socks over support hose for long periods also risk blistering of the feet due to sliding contact between the two unattached sock layers. Moreover, the synthetic fabric of the support hose has poor moisture transmitting characteristics. This causes perspiration to collect between the foot and the fabric of the support hose.

One combination garment proposed for men and boys is exemplified in Isley U.S. Pat. No. 3,020,556, issued Feb. 13, 1962. This garment, formed of a plurality of parts, is knit flat and thus includes seams extending longitudinally about the length of the leg portion of the garment. Such seams are both unsightly to observers and uncomfortable to persons wearing those garments. Particularly when the seam is placed upon the inside of the garment, continual wearing of the garment can lead to chaffing or irritation of the wearer's leg or other portion of the wearer's lower body. The possibility of separation of the garment is increased at the seam site when forces are exerted thereon by the wearer's movements in stretching or bending. Furthermore, manufacture of such seamed garments is both costly and time consuming.

Seamless knitting machines, or circular knitting machines, are of limited use in making undergarments. The typical size of a cylinder on a seamless knitting machine ranges from about 3.5 inches to about 4.0 inches, more specifically, from about 3.5 inches to about 3.75 inches in diameter. Moderately heavy two-way stretching yarns, fibers or blends have a limited maximum diameter when knitted in a 3.5 to 3.75 inch tubular blank. The blanks so produced lack sufficient stretchability to stretch and encompass the largest portion of the male (or female) leg, i.e., the highest thigh portion.

While yarns, fibers or blends of a finer denier and higher needle count can be employed to impart greater stretchability, as in women's panty hose, such materials do not provide adequate warmth characteristics. Moreover, the appearance of an undergarment constructed with such finer denier fibers would resemble conventional women's panty hose and thus would be unacceptable to men. Conversely, use of bulky fibers, e.g., as in long underwear, results in a bulky product less suitable for general wear under clothing. Men thus have no garment comparable to women's panty hose which is of a relatively simply construction, is easy to manufacture, and which is free of the foregoing disadvantages.

An outer sock joined at the toe to the toe end of an undergarment suitable for men has been proposed in Staley U.S. Pat. No. 4,870,708, issued Oct. 3, 1989. However, the described undergarment is difficult to manufacture using a circular knitting machine due to the difference in diameter between the weight fabric than conventional women's panty hose, as described above. The present invention provides an improved undergarment which solves this problem.

SUMMARY OF THE INVENTION

The present invention provides a one-piece undergarment suitable for use by men. An undergarment according to the invention includes a pair of tubular leg portions made of a resilient fabric, and a pair of sock portions joined, e.g., continuously knitted, with the leg portions. The thigh portions of the undergarment have stretch panels having greater stretchability than the rest of the leg portion, permitting the undergarment to fit comfortably along the entire length of the leg and sock portions, while allowing most of the leg portion to be made from a heavier, lower cross-stretch material than would otherwise be possible.

According to one aspect of the invention, the stretch panels are formed by selectively knitting areas on the inside and outside of the thigh on each leg so that the stretch panels are lighter and more stretchable than the rest of the leg portions. The stretch panels are generally elongated in the lengthwise direction of the leg portions, and may extend all the way from the waist to the sock portions, or a lesser distance, as needed.

BRIEF DESCRIPTION OF THE DRAWING

The invention will now be described with reference to the accompanying drawing, wherein like numerals denote like elements, and.

DETAILED DESCRIPTION

Figure 1:
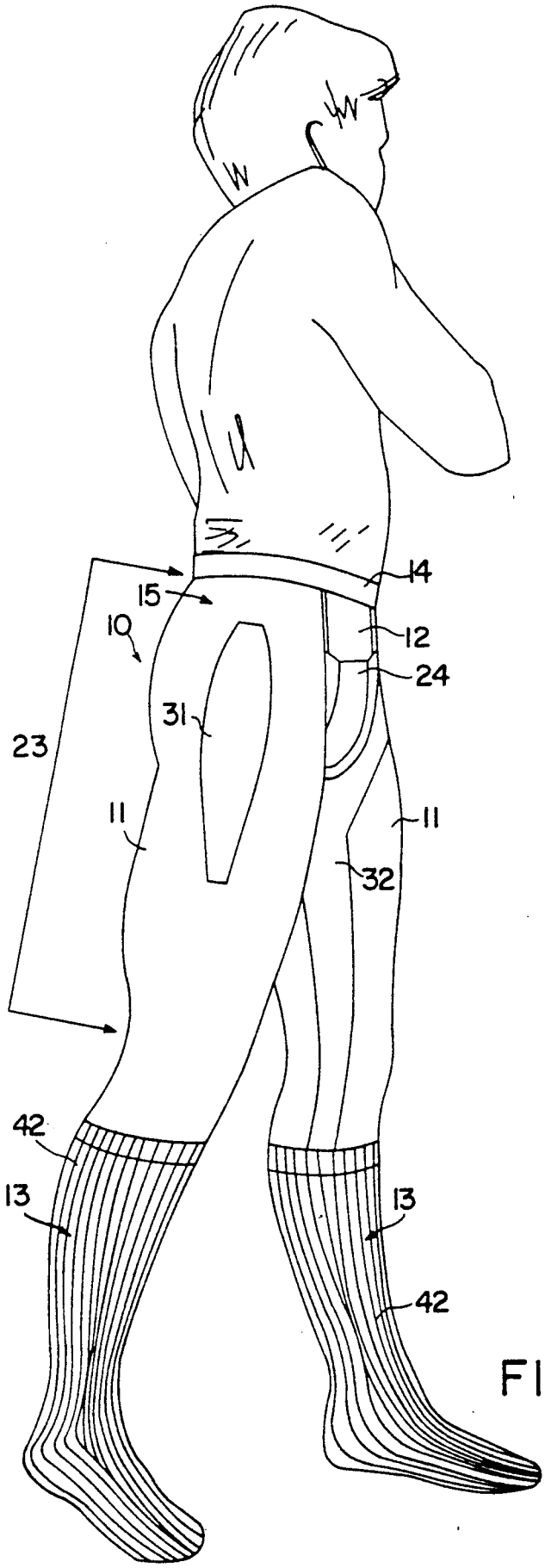
FIG. 1 is a perspective view of an undergarment according to the invention being worn by a man.

Referring now to FIG. 1, an undergarment 10 according to the invention comprises a pair of leg portions (tubes) 11 having a crotch panel (patch) 12 sewn therebetween to form an underpant portion 15 and a pair of double sock portions 13. Each of these portions of undergarment 10 will be hereafter described in detail.

As illustrated in FIG. 1, undergarment 10 includes a top waistband 14 preferably made of conventional elastic material of the type used in men's underwear. Waistband 14 adjoins crotch panel 12. A pair of upper thigh portions 23 of leg portions 11 make up the main part of the garment below waistband 14 on either side of panel 12. Crotch panel 12 includes a horizontal fly 24. Fly 24 may be omitted, if desired, for an undergarment according to the invention to be worn by women.

Figure 2:
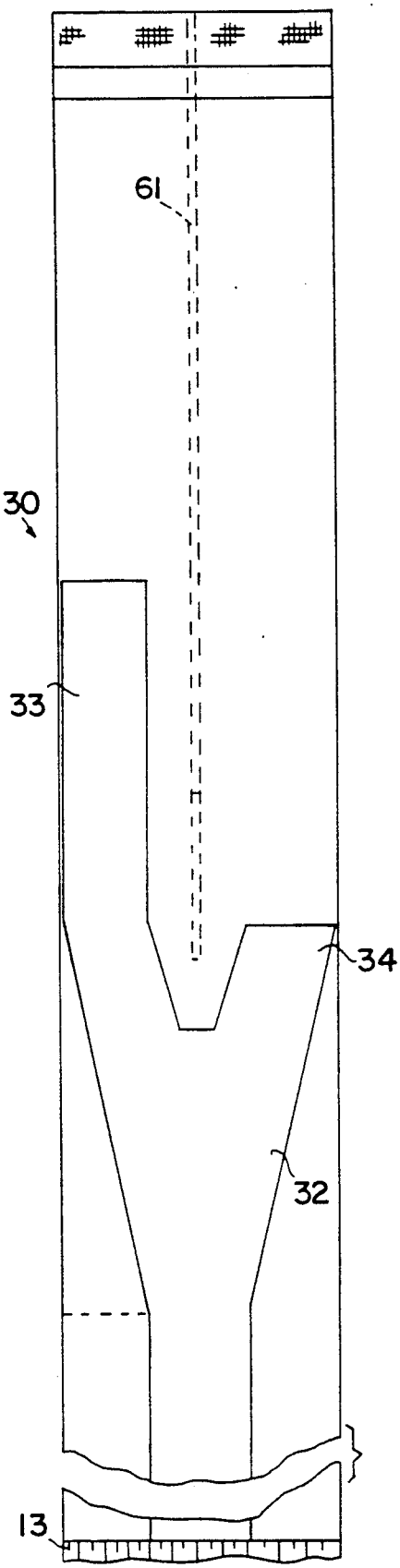
FIG. 2 is a partial plan view of the inner side of a leg blank according to the invention.
Figure 3:
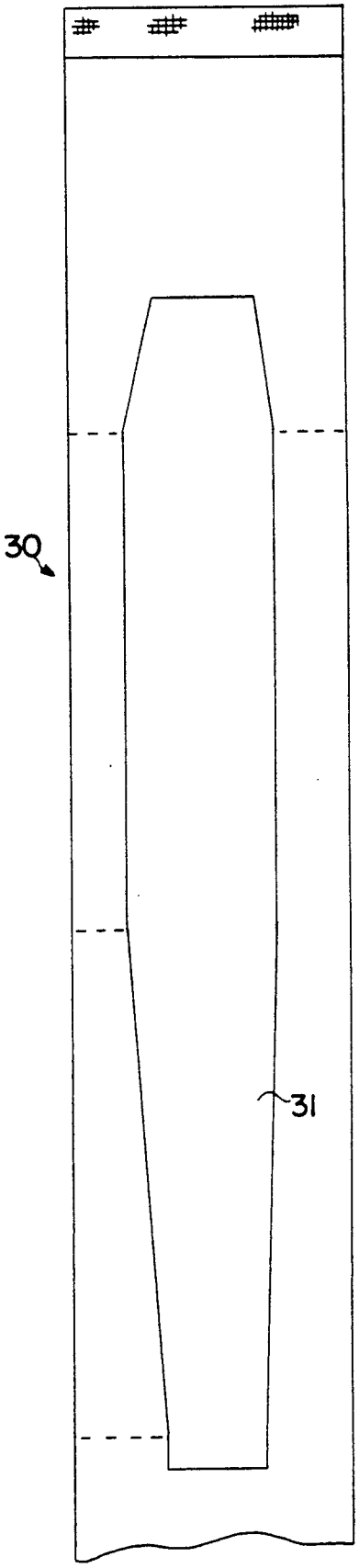
FIG. 3 is a partial plan view of the outer side of the blank shown in FIG. 2.

Referring to FIGS. 1-3, leg portions 11 have respective inner and outer stretch panels 32, 31. In general, panels 31, 32 extend lengthwise along a major portion of the upper thigh portion of legs 11, the thigh portion being from the knee up to the waist. At this location leg portions 11 must stretch most greatly, typically to about 3 times normal (unstretched) circumference. Inner panels 32 preferably have the upwardly opening Y-shape so that the arms 33, 34 of panels 32 provide stretch in the inner thigh area. The exact size, number and placement of the stretch panels is not critical, but the panels 31, 32 of this embodiment are preferred insofar as this embodiment provides an undergarment having the stretch and comfort desirable for men without seams sewn in. Alternative embodiments include a single, inner or outer stretch panel for each leg tube, or a series of narrow stretchable stripes around most or all of the leg tube circumference.

Leg portions 11 preferably extend below the knee area but end above the ankles and are preferably made of light-weight, resilient natural or synthetic fabrics such as nylon, lycra, spandex, silk, polypropylene, and combinations thereof. The weight of undergarment 10 is also important. If the undergarment is too light it will resemble women's panty hose. If it is too heavy the garment will become bulky and possibly hot to wear. To provide a suitable weight and feel, leg portions 11 should be made of a yarn or yarns having a total fineness in the range of at least 120 denier, preferably in the range of 120 to 500 denier, most preferably about 180 to 340 denier. For example, 2-ply 80-denier nylon yarn doubled with 2-ply 60 denier polypropylene ($P^2$) yarn yields a total fineness of 300 denier. Sock portions 13 (as single socks or each of sock portions 41, 42) can have the same fineness ranges as leg portions 11, but will commonly be somewhat heavier than leg portions 11. For the latter purpose sock portions 13 have a total fineness in the range of 200 to 500 denier, especially 300 to 460 denier.

Various combinations of commercially available nylon with orlon or spandex yarns may be used in making leg portions 11. In a preferred embodiment, leg portions 11 are knitted with a doubled yarn of nylon and polypropylene, and panel 12 is also made the same nylon-polypropylene.

In circular knitting, needle count refers to the number of stitches in one circumference of the knitted tube. A higher needle count allows more stretch, but heavier, bulkier yarns generally require lower needle counts than lighter, finer yarns. Yarns of the foregoing types and weights, when formed into knitted tubes having a needle count in the range of 144 to 240, particularly 160–200, have a stretch factor of about 2.5 or less, more commonly 2 or less. This stretch factor is the ratio between the circumference of the tube when stretched to the maximum extent possible without damaging the garment and the circumference of the same tube in an unstretched condition. A typical tube of plaited 140 denier nylon/ 100 denier polypropylene yarn having a 3.75 inch diameter (1.875" radius) having a stretch factor of 2 could expand from its relaxed circumference of 11.78" to a maximum stretched circumference of 23.56". However, the thigh of the wearer may have a circumference of 24" or more, particularly 24–30 inches.

To increase the overall stretch factor of the tube, a stretch panel 2" wide at its widest point and having a stretch factor of 3.5 may be incorporated into the leg tube. The preceding 3.75" diameter tube at that location now includes 9.78" of SF 2 material and 2" of SF 3.5 material. The maximum circumference of the composite tube in its stretched condition then becomes (2 * 9.78")+(3.5 * 2")=26.56", which is large enough to fit a 24–26" thigh. The width of the stretch panel can be varied as needed for the desired size of the undergarment. According to a preferred aspect of the invention, a leg tube made of a material having a stretch factor of 2.5 or less, especially 2 or less, is provided with one or more stretch panels having a stretch factor of 3 or more, especially 3.5 or more.

With a stretch panel having a stretch factor of 3 and a leg tube having a stretch panel of 2.5, the stretch panel has 20% more cross-stretch than the rest of the leg tube (3/2.5=1.2). It is most preferred that the stretch panel have at least 10% more cross stretch than the rest of the leg tube, preferably 20–50%. As to size, a stretch panel according to the invention in an unstretched condition generally has a length of at least 14 inches, preferably 15–20 inches, and a width at its widest point of at least about 2 inches. More generally, the stretch panel accounts for at least about 10%, particularly 10–60% of the total circumference of the leg tube in an unstretched condition along a major part of the length of the stretch panel.

FIGS. 2 and 3 show opposite sides of a tubular leg blank 30 according to the invention from which leg portions 11 and sock portions 13 are made. Since each blank 30 is made by circular knitting with a diameter typically in the range of 3.5 to 4 inches, panels 31, 32 are most readily made by knitting blanks 30 with a double yarn. Such a double yarn includes a first, highly stretchable yarn, such as stretch nylon as the inside technical face, and a second, less stretchable yarn such as polyester or polypropylene as the outside technical face. The second yarn can be of the same or different weight as the first yarn. Leg and sock portions 11, 13 are made by knitting a 3.5–4 inch diameter tubular blank 30 wherein the second yarn is plaited over the first yarn. To form stretch panels 31, 32, the second yarn is selectively omitted, the ends being cut off during knitting where needed, to form the perimeter of panels 31, 32. These panels comprise only the first yarn (i.e., the higher cross-stretch yarn used on the tube's inside technical face) and can stretch to a greater extent than the rest of leg portion 11 wherein the second yarn is doubled with the first yarn.

Panels 31, 32 could also be made by other knitting techniques, such as by using intarsia to substitute a more stretchable yarn for the heavier, less stretchable yarn used in the main portion of the leg tube. The stretch panel could effectively become the entire upper end (thigh portion) of the leg tube, or could be fashioned as a band that extends around 100% of the circumference of the leg tube. This method would, however, be difficult to carry out on a circular knitting machine.

Figure 4:
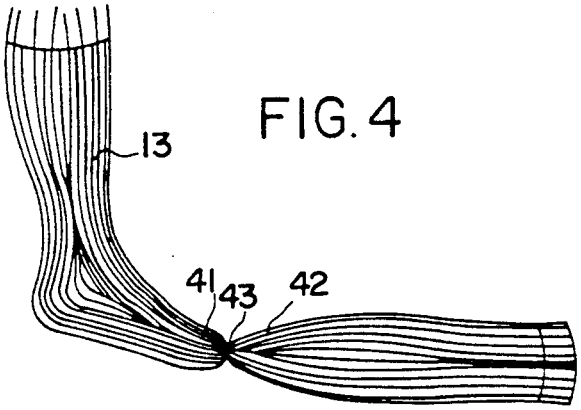
FIG. 4 is a partial perspective view of the embodiment shown in FIG. 1 with the outer sock pulled off of the inner sock.

Referring now to FIG. 4, double sock portions 13 each comprise an inner sock 41 having water vapor transfer properties and an outer sock 42 which is water absorbent. Inner sock 41 is made of a material which is substantially non-water absorbent and which is water-pervious, so that it tends to draw moisture away from the foot into outer sock 42. Polypropylene fibers have these characteristics, and inner sock portion 41 (and leg 11 also) is preferably made of at least 20%, especially at least 30% by weight of polypropylene, the preferred ranges being 30–80%, particularly 50–90% polypropylene. Since polypropylene fibers of the type useful in a sock tend to have limited resiliency, inner sock 41 preferably contains no more than 80%, especially 20–70% by weight of a second yarn which has the needed stretchability, such as stretch nylon.

Outer sock 42 may be made of any conventional, moisture-absorbing sock yarn, such as a wool, acrylic, nylon, orlon, cotton, or yarn blends thereof. Outer sock 42 is typically heavier and more bulky than inner sock 41 to provide more warmth. In the illustrated embodiment, outer sock 42 is knitted in substantially the same manner as sock 41, using an inner facing or outer facing of stretch nylon interlooping with the absorbent yarn such as cotton, wool, acrylic, etc. Outer sock 42 may have a small vent panel located near its toe end on the top of the sock, as described in the foregoing patent application Ser. No. 07/475,340, the entire contents of which are incorporated by reference herein.

Inner and outer socks 41, 42 are secured together by any suitable means, such as sewing, Velcro or snap fasteners, or the like. The entire double-sock may be continuously knitted from a single tube together with the leg portion by switching the second yarn from the vapor transfer yarn at the toe end of sock portion 41 to the absorbent yarn at the beginning of the portion of the tube which will become outer sock portion 42, and sewing the tube together at the toe end to form a double-tube sock. In the illustrated embodiment, sock portions 41, 42 are knitted separately and then sewn together toe-to-toe by a fishmouth seam 43. Optionally, sock portions 41, 42 may also be sewn together at a second location, such as at the heel, to prevent the two socks from slipping relative to one another when worn.

Figure 5:
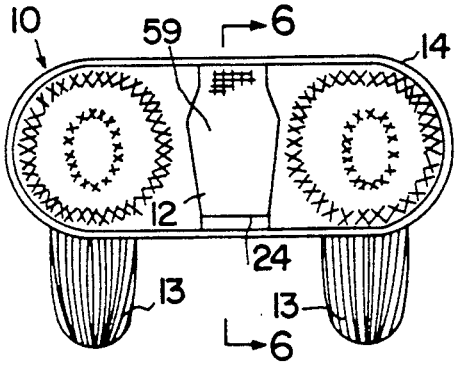
FIG. 5 is a top view of the undergarment shown in FIG. 1.
Figure 6:
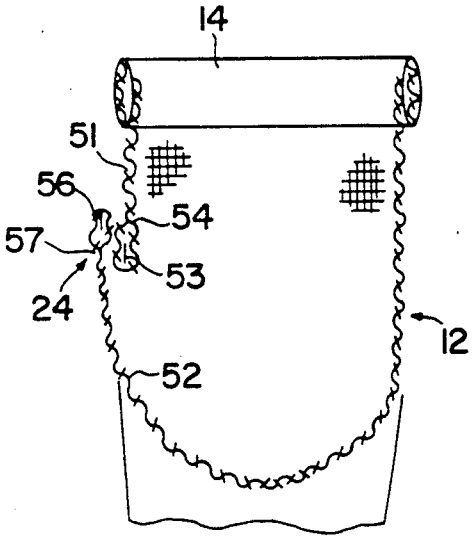
FIG. 6 is a partial, lengthwise sectional view along the line 6—6 in FIG. 5.

FIGS. 5 and 6 illustrate a crotch panel 12 according to the invention. In the embodiment shown, panel 12 comprises a pair of overlapped underlay and overlay panels 51, 52. The lower end of underlay 51 is folded upwardly over an elastic insert 53 and secured thereover along a seam 54. Insert 53 is sewn at its ends to underlay 51. The resulting elastic band serves as the inside of fly 24.

Overlay 52 is similarly folded over a second elastic insert 56 and sewn along a horizontal seam 57 to form the outside of fly 24. A patch of a breathable material such as cotton or cotton-polyester (not shown) may be sewn to the inside of the front portion of overlay 52 to provide a lining, e.g., to provide an undergarment of the invention suitable for women. Underlay 51 and overlay 52 may be made from the same knitted material as the leg tubes 11.

According to one example of the method of the invention, a pair of seamless tubular blanks such as blanks 30 are knitted on a circular knitting machine using a conventional Jersey (stockinette) stitch. The ends of two strands of suitable yarn, e.g., of 2-70-34 (2-ply, 70 denier, 34 filaments per strand) stretch nylon of two different selected colors are ply twisted to a total weight of 140 denier. A second yarn made of polypropylene or any similar fiber is floated over (plaited on top of) the first yarn during the circular knitting process to form the main portion of the tube. The second yarn typically is a 2-60-20 polypropylene fiber. In the areas of stretch panels 31, 32, the polypropylene yarn is omitted, and the polypropylene ends along the side edges of panels 31, 32 are cut. Thus, panels 31, 32 are made of the stretch nylon only, giving panels 31 greater stretchability and lighter weight. Leg portions made of these yarns have particularly proper weight for warmth, stretchability and vapor transfer properties.

If only a single sock is desired, the blanks are then sewn closed at the toe. If an outer sock 42 is to be included, the blank is drawn together and sewn at seam 43 to form the toe portions of respective socks 41, 42. In the alternative, a pair of separate socks 42 may be sewn onto the toe ends of each inner sock 41.

Panel 12 is then sewn to leg tube blanks 30. Each identical blank 30 is cut lengthwise along a line 61 (FIG. 2) which extends from the top edge of blank 30 to a point close to stretch panel 32 between arms 33, 34. Panel 12 is sewn at its side margins, e.g., with a flat-locking serge seam, to each blank 30 at the margins (cut portions) formed by cutting each blank along line 61. In this manner blanks 30 are sewn to opposite sides of crotch panel 12 as shown in FIG. 5. Waistband 14 is sewn on along the upper edge of blanks 30 and panel 12 to form the completed undergarment 10.

An undergarment according to the foregoing embodiment of the present invention can provide men with extra warmth and leg support without restrictive bulkiness. It combines socks, underwear and leg-covering stockings into a single garment, eliminating the need to put on three separate garments, i.e., underwear, socks, and tights or panty hose. The sock portion is continuously knitted with the legs of the undergarment, avoiding the need for unsightly stitching at the top of the sock, and keeping the sock from sagging at all times. The sock portion, if made elastic, does not require a thin, constricting elastic band at the top of the sock. Running is generally not a problem with the undergarment according to the invention because the yarns used are generally heavier than the yarns used in women's panty hose.

It will be understood that the above description is of preferred examples of the invention, and that the invention is not limited to the specific forms shown. Modifications may be made in the design and arrangement of the elements without departing from the scope of the invention as expressed in the appended claims.

I claim:

1. A method for making an undergarment, comprising the steps of:

circularly knitting a pair of tubular blanks using a doubled yarn comprising a first yarn and a second yarn, each blank having a pair of open ends;

selectively omitting the second yarn during knitting of each blank to form a stretch panel proximate one end of each blank made of the first yarn only, the stretch panel of each blank having greater cross-stretch than the portion of each blank made from the doubled yarn;

sewing the other end of each blank closed to form sock portions;

cutting each blank in a lengthwise direction at the end of each blank proximate each stretch panel to form cut portions; and sewing the cut portions of the blanks to a crotch panel to form leg and underpant portions of the undergarment.

2. The method of claim 1, wherein the second yarn is less stretchable than the first yarn.

3. The method of claim 2, wherein the second yarn is made of polypropylene.

4. The method of claim 3, wherein the first yarn is made of stretch nylon.

5. The method of claim 1, wherein the cutting step further comprises cutting each blank along a straight line from an edge of the blank at the end thereof proximate the stretch panel to form the cut portions at positions spaced from each stretch panel.

6. The method o claim 1, further comprising repeating the step of omitting the second yarn for each blank to form a second stretch panel on each blank, so that the leg portions of the undergarment each have an outside stretch panel disposed on an outside of the leg portion and an inside stretch panel disposed on an inside of the leg portion, the inside and outside stretch panels of each leg portion being circumferentially spaced-apart from each other.

7. The method of claim 1, wherein step of omitting the second yarn further comprises forming the stretch panels in opposed positions on the inside of each leg portion.

8. The method of claim 1, wherein step of omitting the second yarn further comprises forming each stretch panel in a Y-shape, with arm portions of each stretch panel extending toward the underpant portion.

9. The method of claim 8, wherein the cutting step further comprises cutting each blank along a straight line from an edge of the blank at the end thereof proximate the stretch panel to a position between the arms of each stretch panel.

10. The method of claim 1, wherein each stretch panel in an unstretched condition has, along at least about half its length, a width which is at least about 10% of the circumference of each blank, and each stretch panel has at least 10% more cross-stretch than the portion of the blank made from the doubled yarn.

11. The method of claim 1, wherein the first and second yarns have a total fineness of at least about 120 denier.

12. The method of claim 1, wherein the stretch panels have a stretch factor of at least 3, and the remainder of each tubular leg portion has a stretch factor of about 2.5 or less.

13. The method of claim 1, wherein the crotch panel is generally rectangular and comprises a pair of overlapped underlay and overlay panels which form a fly, and the step of sewing the cut portions to the crotch panel further comprises sewing the cut portions along opposite side edges of the crotch panel.

14. The method of claim 1, further comprising sewing an elastic waist band to the leg and underpant portions.

15. The method of claim 1, wherein the omitting step further comprises cutting ends of the second yarn along side edges of each of the stretch panels.

16. The method of claim 1, wherein the tubular blanks are knitted in a diameter in the range of about 2.5 to 4 inches.

17. A method for making an undergarment, comprising the steps of:

circularly knitting a pair of tubular blanks with a stockinette stitch using a doubled yarn comprising a first yarn and a second yarn less stretchable than the first yarn, the first and second yarns having a total fineness of at least about 120 denier, each blank having a pair of open ends;

selectively omitting the second yarn during knitting of each blank to form a stretch panel proximate one end of each blank made of the first yarn only, the stretch panel of each blank being elongated in the lengthwise direction of the blank and having greater cross-stretch than the portion of each blank made from the doubled yarn, such that each stretch panel in an unstretched condition has, along at least about half its length, a width which is at least about 10% of the circumference of each blank, and each stretch panel has at least 10% more cross-stretch than the portion of the blank made from the doubled yarn;

sewing the other end off each blank closed to form sock portions;

cutting each blank in a lengthwise direction at the end of each blank proximate each stretch panel along a line from an edge of the blank to form cut portions at positions spaced from each stretch panel; and sewing the cut portions of the blanks to a crotch panel to form leg and underpant portions of the undergarment.

18. The method of claim 17, wherein the second yarn is made of polypropylene and the first yarn is made of stretch nylon.

* * * * *